United States Patent [19]

Board

[11] 4,394,139

[45] Jul. 19, 1983

[54] DIRECT CONTACT CONDENSER AND SEPARATING METHOD

[75] Inventor: Robert D. Board, Boca Raton, Fla.

[73] Assignee: Ecolaire Incorporated, West Easton, Pa.

[21] Appl. No.: 354,825

[22] Filed: Mar. 4, 1982

[51] Int. Cl.[3] ..... B01F 3/04

[52] U.S. Cl. ..... 55/20; 55/94; 55/229; 55/260; 261/DIG. 10; 261/39 R; 261/113

[58] Field of Search ..... 55/20, 94, 260, 229; 261/DIG. 10, 39 R, 113

[56] References Cited

U.S. PATENT DOCUMENTS

| | | | |
|---|---|---|---|
| 1,508,985 | 9/1924 | McDermet | 55/20 |
| 1,880,018 | 9/1932 | Harmon . | |
| 3,395,510 | 8/1968 | Barnes | 55/20 |
| 3,575,392 | 4/1971 | Stoker et al. . | |
| 3,616,597 | 11/1971 | Stewart | 55/94 |
| 3,898,059 | 8/1975 | Foster | 55/94 |
| 3,911,067 | 10/1975 | Chen et al. | 261/DIG. 10 |
| 3,931,371 | 1/1976 | Maurer et al. | 261/DIG. 10 |
| 3,932,150 | 1/1976 | Komai et al. | 55/20 |

FOREIGN PATENT DOCUMENTS

| | | | |
|---|---|---|---|
| 496281 | 9/1978 | Australia | 55/94 |
| 1051247 | 2/1959 | Fed. Rep. of Germany | 55/94 |
| 54-8212 | 1/1979 | Japan | 261/DIG. 10 |

*Primary Examiner*—Tim R. Miles
*Attorney, Agent, or Firm*—Seidel, Gonda & Goldhammer

[57] ABSTRACT

The housing of a direct contact condenser has a partition with a manifold water supply adapted to discharge water to opposite sides of the partition. A plurality of showers are disposed below the elevation of the water supply and through which a gas stream will pass sequentially. Each shower receives water from one side of the partition. The last shower is provided with temperature sensors which are connected to a valve for controlling water flow in response to either the temperature of the fluid and the water at the last shower.

6 Claims, 2 Drawing Figures

DIRECT CONTACT CONDENSER AND SEPARATING METHOD

BACKGROUND OF THE INVENTION

Direct contact condensers are known and include a plurality of showers through which steam is sequentially passed. For example, see U.S. Pat. No. 3,575,392. It is known to measure the temperature of a gas stream at a location downstream from a shower and control inlet of water to the shower as a function of such temperature. For example, see U.S. Pat. No. 1,880,018. Neither of the direct condensers taught by said patents are adaptable for use in operation with geothermal steam fields since they liberate pollutants to the air.

In a geothermal steam field, steam is supplied from beneath the surface of the earth. Such steam does not have the same purity as steam produced by a boiler. Instead, such steam is heavily laden with non-condensible gases such as ammonia, carbon dioxide, hydrogen sulfide, etc. Aside from the notorious rotten egg smell, such gases could contaminate the surrounding area and the collected condensate.

The present invention is directed to a solution of the problem of how to minimize absorption of gases, especially hydrogen sulfide in the condensate while maximizing recovery of gases which have a polluting effect.

SUMMARY OF THE INVENTION

The present invention is directed to a direct contact condenser particularly adapted for use in geothermal steam fields. The housing of a direct contact condenser has a partition with a manifold water supply adapted to discharge water to opposite sides of the partition. A plurality of showers are disposed below the elevation of the water supply and through which a gas stream will pass sequentially. Each shower receives water from one side of the partition. The last shower is provided with temperature sensors which are connected to the valves for controlling water flow to opposite sides of the partition in response to either the fluid or the water temperature at the last shower. A collection means is provided for collecting water from the last shower while preventing such water from mixing with water from other showers and any condensate.

It is an object of the present invention to provide a novel direct contact condenser which minimizes absorption of noncondensible gases in condensate whereby maximum recovery of such gases may be attained.

It is another object of the present invention to provide a direct contact condenser with selective control of water fed to the last shower in response to differential temperature of the gas downstream and the water in the last shower or differential temperature of the gas flow upstream and downstream from the last shower.

Other objects and advantages will appear hereinafter.

For the purpose of illustrating the invention, there is shown in the drawing a form which is presently preferred; it being understood, however, that this invention is not limited to the precise arrangements and instrumentalities shown.

DETAILED DESCRIPTION

Figure 1:
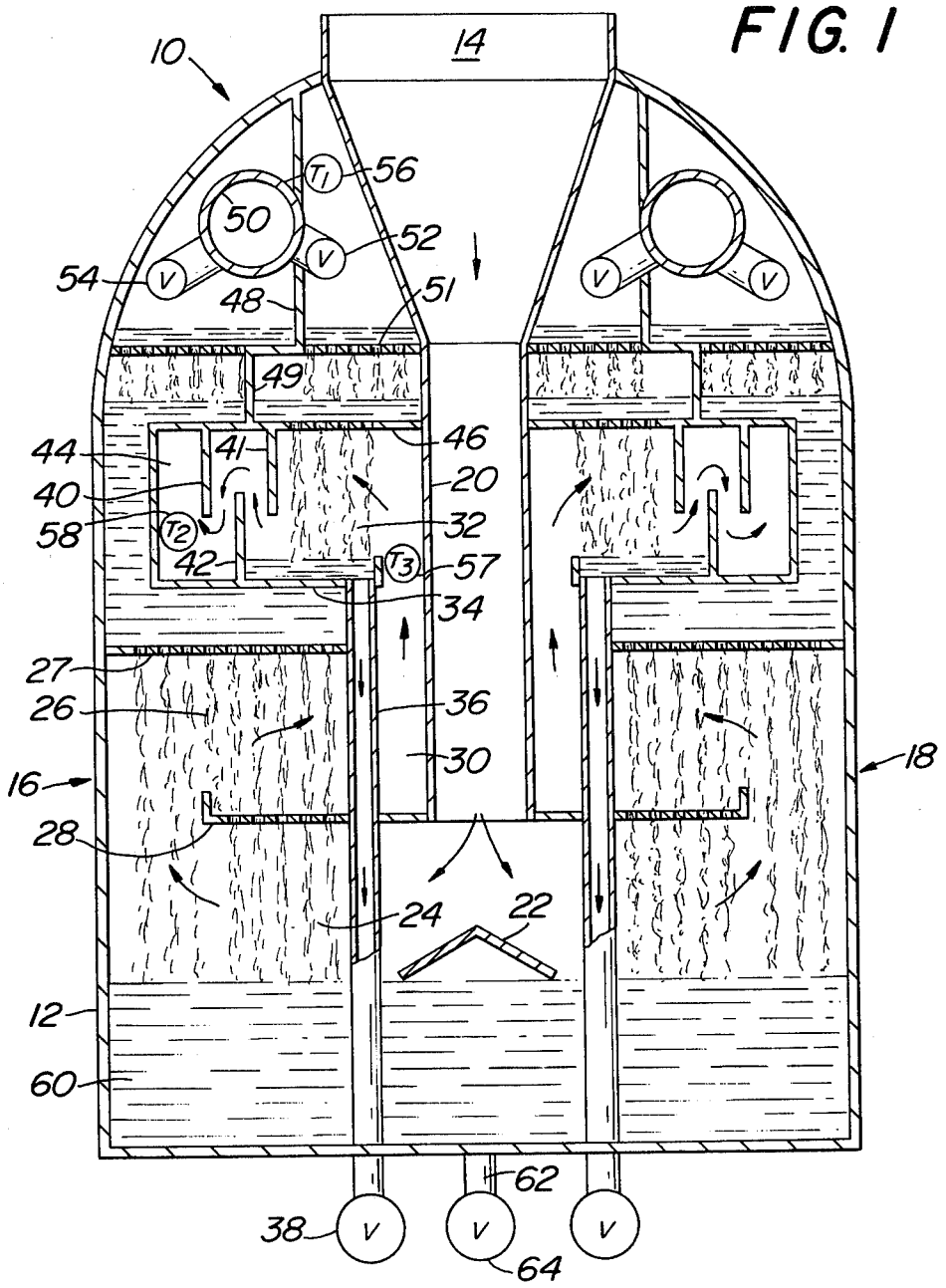
FIG. 1 is a cross-sectional view of the direct contact condenser in accordance with the present invention.

Referring to the drawing in detail, wherein like numerals indicate like elements, there is shown in FIG. 1 a direct contact condenser in accordance with the present invention designated generally as 10. The condenser 10 includes a housing 12 having a steam inlet 14 in the upper end thereof. Within the housing there is provided a first condenser section 16 and a second condenser section 18 which are identical with one another. Hence, only condenser section 16 will be described in detail.

Steam from a geothermal field is introduced by way of inlet 14 into the conduit 20. From the conduit 20, the steam may flow downwardly to the baffle 22 and will there diverge with part of the steam being fed to each of the condenser sections 16, 18.

As the steam flows through the condenser section 16, it passes through a first shower 24 of water. The first shower 24 is defined at the upper end by a perforated plate 28. As the steam passes through the shower 24, a portion of the steam will condense. The flow continues around plate 28 and through a second shower 26. Second shower 26 is defined at the upper end by perforated plate 27. From the second shower 26, the steam passes upwardly through a vertical channel or flow passage 30 to a third shower 32.

The third shower 32 includes an imperforate tray 34 communicating with a discharge conduit 36 which exits the housing 12 and includes a valve 38. Any condensate collecting in tray 34 is not permitted to mix with any other condensate within the housing 12. The gas stream exiting from the last shower 32 passes between baffles 41, 40, 42 and into the chamber 44. A vacuum pump or its equivalent is connected to the chamber 44 for pumping off noncondensible gases. The walls defining chamber 44 are connected to the horizontally disposed perforated plate 46 which defines the upper end of the third shower 32. A partition 49 extends upwardly from plate 46 to perforated plate 51. The head of water between plates 46, 51 is controlled by the size and number of perforations in plate 46.

Extending upwardly from the perforated plate 51 there is provided a center partition 48. A water supply conduit 50 is provided. Water may be discharged by way of a conduit to either side of the partition 48 from the manifold conduit 50. Each side conduit terminates in a valve 52 or a valve 54. Valves 52 and 54 are preferably solenoid valves controlled by the differential between thermostats 56 and 58. The condensate from each of the showers 24, 26 is designated 60 and accumulates in the bottom of the housing 12. The bottom wall of the housing 12 is provided with an outlet conduit 62 which includes a valve 64. The condensate 60 is handled separately from the water collected in tray 34.

The last shower 32 sees about 3 to 5% of the initial steam flow into the condenser 10. This 3–5% of flow is heavily laden with noncondensible gases, and any of such noncondensible gases which are absorbed by the water in shower 32 collect in tray 34 and discharge through conduit 36 without mixing with the condensate 60. Conduit 36 may be directed to a site where it can discharge underground to the source well or may discharge into a suitable location for further treatment. Gases such as hydrogen sulfide can be removed from the gas stream that enters the outlet chamber 44 after being removed therefrom by way of a vacuum pump or ejector.

One measure of the concentration of hydrogen sulfide in the gas stream passing through the last shower 32 is attained by measuring the temperature of the water in tray 34 and comparing the same with the temperature of the water upstream from perforated plate 46. In the preferred embodiment, the measure of concentration of hydrogen sulfide in the gas stream passing through the last shower 32 is attained by measuring the temperature of the gas flow downstream from shower 32 and the water temperature by thermostats 56 and 58. Alternatively, the temperature differential of the gas stream on opposite sides of shower 32 by thermostats 58 and 57 may be used as a control. It is preferred to use thermostats 56 and 58 since their locations facilitate ease of installation, reliability, and maintenance. Thus, thermostat 56 may be physically located in water supply conduit 50 where it enters housing 12 and thermostat 58 may be physically located where chamber 44 exits housing 12.

Under ideal conditions the temperature of thermostat 58 would be within 2° celcius of the temperature of thermostat 56 per each percent change in cooling water flow. That temperature differential can vary due to various factors including locations of thermostats, pressure, etc.

Figure 2:
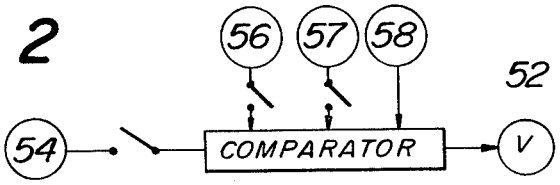
FIG. 2 is a schematic wiring diagram.

The temperature readings attained by the thermostats 56 and 58 are compared by a conventional comparator and the differential is utilized to control valve 52 to add more or less water to the last shower 32. See FIG. 2. It is desired to cause 95 to 97% of the steam entering the inlet 14 to be condensed before the stream reaches the last shower 32. Initial adjustments would be made depending upon the results of measuring the concentration of hydrogen sulfide in the condensate 60. Thereafter, the temperature differential at the thermostats 56, 58 may be utilized by comparing the same with a set point whereby further chemical analysis of the condensate 60 is unnecessary.

Thus, it will be noted that one unique feature of the present invention is the separate and isolated treatment at the last shower 32 so that condensate therein does not mix with condensate 60. Another unique feature of the present invention is the independent supply of water for the last shower 32 whereby it receives its water from one side of the partition 48 while the remaining showers receive their water from the other side of the partition 48. Another unique feature of the present invention is the control of water flow to one or both sides of the partition 48 as a function of gas temperature upstream and downstream at the last shower 32 or gas temperature and water temperature. As a result of the unique features of the present invention, water containing a large amount of noncondensible gases is not mixed with other condensate and at the same time such gases are available for recovery in a conventional off-gas process communicating with outlet chamber 44.

The present invention may be embodied in other specific forms without departing from the spirit or essential attributes thereof and, accordingly, reference should be made to the appended claims, rather than to the foregoing specification, as indicating the scope of the invention.

I claim:

1. A direct contact condenser including a housing having a partition, a manifold water supply conduit having valves for discharge to opposite sides of the partition, means defining a plurality of showers below the elevation of said partition and through which a gas stream will pass sequentially, each shower receiving water from one side of said partition, means for introducing a gas stream sequentially through said showers, the last shower being provided with temperature sensors, means for controlling water flow from said supply conduit to said last shower in response to the differential of said sensors, and collection means for collecting water from said last shower while preventing the collected water from mixing with water from other showers, and an outlet chamber downstream from said last shower where noncondensible gases collect for subsequent treatment.

2. A condenser in accordance with claim 1 including walls defining vertically disposed showers for contact with a gas stream moving horizontally therethrough.

3. Apparatus in accordance with claim 1 wherein said temperature sensors are arranged to measure the temperature of gas flow downstream from said last shower and the temperature of water upstream from said last shower.

4. A condenser in accordance with claim 1 wherein said last shower receives water from one side of said partition, the remaining showers receiving water from the other side of said partition.

5. A method of separating steam and noncondensible gases from a geothermal steam field comprising the steps of sequentially passing the stream of steam and gases through a plurality of water showers, removing up to about 95% of steam prior to the stream reaching the last shower, measuring the temperature of the water or the stream upstream and downstream from the last shower, collecting noncondensible gases for subsequent treatment, collecting the water from the last shower and independently removing the same so as to prevent mixing with the main body of condensate, feeding water from one side of a partition to the last shower, feeding water from the other side of the partition to the other showers, controlling the flow of water to one or more of the showers as a result of the temperature differential of said measurements.

6. A method in accordance with claim 5 including passing the stream horizontally through said showers which are vertically disposed.

* * * * *